US009581301B2

(12) United States Patent
Hall et al.

(10) Patent No.: US 9,581,301 B2
(45) **Date of Patent: *Feb. 28, 2017**

(54) ILLUMINATION ASSEMBLY

(71) Applicant: Brandon Medical Company Limited, Leeds (GB)

(72) Inventors: Graeme Hall, Leeds (GB); Euan Morrison, Cambridge (GB)

(73) Assignee: Brandon Medical Company Limited (GB)

( * ) Notice: Subject to any disclaimer, the term of this patent is extended or adjusted under 35 U.S.C. 154(b) by 290 days.

This patent is subject to a terminal disclaimer.

(21) Appl. No.: 14/166,072

(22) Filed: Jan. 28, 2014

(65) Prior Publication Data

US 2014/0140057 A1 May 22, 2014

Related U.S. Application Data

(63) Continuation of application No. 12/825,943, filed on Jun. 29, 2010, now Pat. No. 8,672,507.

(30) Foreign Application Priority Data

Jan. 16, 2008 (WO) ..... PCT/GB2008/000142
Jul. 29, 2008 (GB) ..... 0813834.9
Jan. 6, 2009 (WO) ..... PCT/GB2009/000005

(51) Int. Cl.
*F21K 99/00* (2016.01)
*F21S 4/00* (2016.01)
*H05B 33/02* (2006.01)

(52) U.S. Cl.
CPC ..... *F21K 9/62* (2016.08); *F21K 9/00* (2013.01); *F21S 4/00* (2013.01); *H05B 33/02* (2013.01);
(Continued)

(58) Field of Classification Search
CPC ..... F21K 9/54; F21K 9/00; F21Y 2113/005; H05B 33/02; F21S 4/00
See application file for complete search history.

(56) References Cited

U.S. PATENT DOCUMENTS 6,483,651 B1 * 11/2002 Maurer ..... G02B 25/002 359/802
6,636,003 B2 10/2003 Rahm et al.
(Continued)

FOREIGN PATENT DOCUMENTS

DE 102005043783 10/2006
EP 1 462 711 9/2004
(Continued)

OTHER PUBLICATIONS

Chenua You, "Visual equivalence of light-emitting diode white light", Optical Engineering, vol. 44, No. 11, Nov. 1, 2005, pp. 111307-1-111307-7, XP007904563 (Abstract Only).
(Continued)

*Primary Examiner* — Sharon Payne

(57) ABSTRACT

The present invention relates to an illumination assembly comprising a specific combination of one or more white LEDs and one or more red-orange LEDs with improved spectral characteristics (e.g., specific color performance characteristics, such as a desirable color rendering index and color temperature).

17 Claims, 6 Drawing Sheets

(52) U.S. Cl.
CPC ..... *F21Y 2113/13* (2016.08); *F21Y 2115/10* (2016.08); *Y10S 362/804* (2013.01)

(56) References Cited

U.S. PATENT DOCUMENTS

| | | | | |
|---|---|---|---|---|
| 8,201,966 | B2 | 6/2012 | Hall et al. | |
| 8,672,507 | B2 * | 3/2014 | Hall | F21K 9/00 362/231 |
| 9,423,081 | B2 * | 8/2016 | Hall | F21K 9/00 |
| 2002/0070681 | A1 | 6/2002 | Shimizu et al. | |
| 2004/0264193 | A1 | 12/2004 | Okumura | |
| 2005/0117125 | A1 | 6/2005 | Minano et al. | |
| 2005/0127381 | A1 | 6/2005 | Vitta et al. | |
| 2005/0195599 | A1 | 9/2005 | Marka | |
| 2005/0286264 | A1 | 12/2005 | Kim et al. | |
| 2006/0237636 | A1 | 10/2006 | Lyons et al. | |
| 2006/0285323 | A1 | 12/2006 | Fowler | |
| 2007/0139920 | A1 | 6/2007 | Van De Ven et al. | |
| 2008/0130288 | A1 * | 6/2008 | Catalano | H05B 33/0803 362/294 |
| 2008/0212319 | A1 | 9/2008 | Klipstein | |

FOREIGN PATENT DOCUMENTS

| | | |
|---|---|---|
| EP | 1 5689 35 | 8/2005 |
| EP | 1 647 763 | 4/2006 |
| EP | 1 741 975 | 1/2007 |
| JP | 2008300124 | 12/2008 |
| WO | 01/36864 | 5/2001 |
| WO | 02/06723 | 1/2002 |
| WO | 2006/001221 | 1/2006 |
| WO | 2006/105649 | 10/2006 |
| WO | 2008/087404 | 7/2008 |

OTHER PUBLICATIONS

Y. Ohno, "Simulation Analysis of White LED Spectra and Color Rendering", Proc, CIE Symposium '04, LED Light Sources: Physical Measurement and Visual and Photobiological Assessment, [Online] XP002477094, Tokyo Japan, Retrieved from the Internet: URL: http://physics.nist.gov/Divisions/Div844/facilities/photo/Publications/OhnoCIE.2004.pdf> [retrieved on Apr. 17, 2008] (in English).

Application Brief AB21, "Luxeon Product Binning and Labeling," Lumileds Lighting U.S. LLC, May 28, 2004.

International Search Report and Written Opinion (PCT/GB2009)000005); Jul. 23, 2009.

* cited by examiner

ILLUMINATION ASSEMBLY

CROSS-REFERENCE TO RELATED APPLICATIONS

This application is a continuation of U.S. application Ser. No. 12/825,943, filed Jun. 29, 2010; which claims priority and benefit under 35 U.S.C. 120 and 365(c) as a continuation of International Application No. PCT/GB2009/000005, filed on Jan. 6, 2009; which claims benefit under 35 U.S.C. 365(b) of International Application No. PCT/GB2008/000142, filed Jan. 16, 2008, and Great Britain Application No. 0813834.9, filed Jul. 29, 2008. The entire contents of each of the above-referenced applications are hereby expressly incorporated herein by reference.

BACKGROUND OF THE INVENTION

The present invention relates to an illumination assembly.

In many applications, the spectral characteristics of a lighting system are critical and may be required to meet certain specifications. One particular example of such an application is medical lighting. A large number of devices exist for medical lighting ranging from large aperture operating theatre lights to lights for general examination and simple tasks. The specifications of these devices are the subject of International standard IEC 60601-2-41:2000. The precise characteristics of medical lighting devices are important to a user, such as a surgeon, doctor or nurse.

Until recently, the characteristics required of medical lighting devices have been provided using light configurations based on, for example, tungsten halogen bulbs. These bulbs are usually used in combination with reflector elements to gather the light from the source and project it into a spot or well defined beam 0.5 m-1 m in front of the reflector aperture. In addition, by using heat filter elements in front of the reflector aperture and/or incorporated into the reflector coating, the majority of the infra-red component of the beam can be removed. Colour shift filters are also used to produce specific colour temperatures. For example, Schott Glass type KG1 can be used to shift a tungsten halogen source at a colour temperature of about 3200K up to a colour temperature of ~4300K.

More recently, a number of manufacturers have started to produce medical lighting devices using high brightness light emitting diodes (LEDs). Commercial examples of these include the iled® (Trumpf) which uses white, green and blue LEDs and the PENTALED® (Rimsa) which uses a small number of high power, high lumen output cold white LEDs. Other commercial devices use LEDs to mix in warm white, but the lumen output is low. Typically, however, these devices require a large number of LEDs to produce the requisite light output for medical lighting (e.g., typically 150 LEDs but often up to 300 LEDs for an operating theatre light). Moreover it is difficult to achieve a good colour rendering index (Ra and R9 in particular are usually low) because of the non-uniform spectral output (i.e., the spectrum has wavelength gaps). As a result of the large number of LEDs and associated hardware, the devices tend to be expensive with poor optical design and inefficient use of the LED light.

U.S. Pat. No. 6,636,003 discloses an LED arrangement which produces white light with an adjustable colour temperature. The arrangement includes one or more white LEDs and one or more coloured LEDs (e.g., amber or red and yellow) to produce an output with a desired colour temperature in the range 2500-5000K. The desired colour temperature is adjusted using first and second driver circuits to control the output of the white LEDs and coloured LEDs, respectively.

WO-A-01/36864, EP-A-1462711, US-A-2006/285323, EP-A-1568935 and Chenhua et al., Optical Engineering, vol. 44, 11 (1 Nov. 2005), 111307-1-111307-7 disclose various systems and methods for generating and modulating illumination conditions provided by lighting fixtures with a plurality of LEDs.

SUMMARY OF THE INVENTION

The present invention is based on the recognition of an improvement in spectral characteristics (e.g., specific colour performance characteristics, such as a desirable colour rendering index and colour temperature) of an illumination assembly using a specific combination of one or more white LEDs and one or more red-orange LEDs. In particular, the present invention provides an illumination assembly which transmits light from one or more white LEDs and light from one or more red-orange LEDs to achieve an output with a desirable colour rendering index and colour temperature.

Thus viewed from a first aspect the present invention provides an illumination assembly capable of emitting an output light comprising:

a housing; and one or more white LEDs emitting a first light along a first path and one or more red-orange LEDs emitting a second light along a second path, wherein the one or more white LEDs and the one or more red-orange LEDs are mounted in the housing such that the first light and the second light are mixed to form the output light transmitted along a third path or to form the output light at a field position, wherein the colour rendering index Ra of the output light is 85 or more and the colour rendering index R9 of the output light is 85 or more.

The illumination assembly of the present invention advantageously exhibits a high colour rendering index (as defined in CIE 13.3:1995) and a useful specific colour temperature. The level of performance is significantly higher than that which can be achieved by using white light LEDs alone. For example, using a minimal number of high brightness LEDs in the assembly of the invention, an extremely high level of colour performance may be achieved (e.g., high Ra and R9 can be achieved at a well-defined specific colour temperatures such as 4300K). The colour characteristics may approximate to those of a blackbody.

Each of the one or more white LEDs and each of the one or more red-orange LEDs may be based on a light emitting polymer, semiconductor dye, organic species, electroluminescent or superluminescent. Specific examples include indium gallium nitride and aluminium indium gallium phosphide.

Each of the one or more white LEDs and each of the one or more red-orange LEDs may be individually mounted in the housing. Each of the one or more white LEDs and each of the one or more red-orange LEDs may be tiltedly mounted in the housing. The output light may take the form of a beam. The output light may be focussed to a spot. By varying the position and tilt of the mounting of the one or more white LEDs or the one or more red-orange LEDs, it is possible in association with beam shaping elements (such as a focusing lens) to achieve a desired beam or spot size, profile and position.

The one or more white LEDs and one or more red-orange LEDs may be clustered. Each cluster may contain only white LEDs or only red-orange LEDs. Each cluster may contain red-orange LEDs and white LEDs which may be randomly distributed. Each cluster may contain red-orange LEDs and white LEDs which may be alternating. In the (or each) cluster, one or more white LEDs may surround a red-orange LED. The cluster may be a regular pattern. The cluster may be a linear, staggered (e.g., herringbone or honeycomb), triangular, hexagonal or circular pattern.

The one or more white LEDs and one or more red-orange LEDs may be provided in an array. Preferably the array is a plurality of discrete clusters (as described above). The array may be a regular pattern. The array may be a linear, staggered (e.g., herringbone or honeycomb), triangular, hexagonal or circular pattern.

In a preferred embodiment, the device is a single colour device (i.e., contains only one colour being the one or more red-orange LEDs).

In a preferred embodiment, each of the one or more white LEDs is a high brightness white LED. Typically the lumen output per Watt is in excess of 15.

In a preferred embodiment, each of the one or more white LEDs is a high power white LED. Typically the input power is 0.5 W or more.

The one or more white LEDs may be a single white LED. The one or more white LEDs may be 2 or more, preferably 3 or more, particularly preferably 4 or more, especially preferably 5 or more white LEDs.

Each of the white LEDs may be a warm white, neutral white or cold white LED. Preferably each of the one or more white LEDs is a cold white LED. Cold white LEDs suitable for use in this embodiment are available commercially from LumiLEDs, Edixeon, Nichia, Cree and Osram.

The white LEDs used in accordance with the invention typically have a correlated colour temperature of 4500K or more, preferably in the range 4500 to 10000K, particularly preferably 4500 to 8000K, more preferably 4700 to 7500K, most preferably 5000-7000K.

In a preferred embodiment, the chromaticity coordinate (X) of each of the one or more white LEDs is in the range 0.270 to 0.480, preferably 0.290 to 0.370, particularly preferably 0.300 to 0.350.

In a preferred embodiment, the chromaticity coordinate (Y) of each of the one or more white LEDs is in the range 0.270 to 0.460, preferably 0.270 to 0.400, particularly preferably 0.310 to 0.375.

Preferably each of the one or more white LEDs is selected from a class of LEDs known as LUXEON® (LumiLEDs). Each LUXEON® white LED may be one from bin NO, NI, PO, PI, QO, RO, RI, RA, UO, UN, UM, VP, VO. VN, VM, WQ, WP, WO, WN, WM, XP, XO, XN, XM, YO or YA. Preferably each LUXEON® white LED is one from bin UO, UN, UM, VP, VO, VN, VM, WQ, WP, WO, WN, WM, XP, XO, XN, XM, YO or YA. A preferred white LED is a LUXEON® selected from the group consisting of bin WN, WO, WX, XN, XO, YA and YO. A preferred white LED is a LUXEON® selected from the group consisting of UO, UN, WN, WO, XN, XO and VN, particularly preferably WN, WO, XN, XO and VN. Particularly preferred is a LUXEON® white LED from bin WO or WN, more preferably a LUXEON® white LED from bin WN.

Preferably each of the one or more white LEDs is a LUXEON®, LUXEON® K2, LUXEON® K2 TFFC, LUXEON® REBEL, LUXEON® III or LUXEON® V LED. An example of a preferred white LED is LUXEON® REBEL LXML-PWC1.

The one or more red-orange LEDs may be a single red-orange LED. The one or more red-orange LEDs may be 2 or more, preferably 3 or more, particularly preferably 4 or more, especially preferably 5 or more red-orange LEDs.

Preferably each of the one or more red-orange LEDs has a dominant wavelength in the range 613 to 645 nm, particularly preferably 613 to 621 nm (e.g., about 617 nm).

Preferably each of the one or more red-orange LEDs is selected from a class of LEDs known as LUXEON® (LumiLEDs). Particularly preferably the LUXEON® red-orange LED is one from dominant wavelength bin 2.

Preferably each of the one or more red-orange LEDs is a LUXEON®, LUXEON® K2, LUXEON® K2 TFFC, LUXEON® III, LUXEON® REBEL, LUXEON® Dental or LUXEON® V red-orange LED. Preferred is a LUXEON® REBEL red-orange LED. An example of a preferred red-orange LED is LUXEON® REBEL LXML-PH01.

In a preferred embodiment of the assembly of the invention, the colour rendering index of the output light is substantially uniform across substantially the whole visible spectrum and is greater than 90.

In a preferred embodiment of the assembly of the invention, the colour rendering index Ra of the output light is 90 or more, particularly preferably 91 or more, more preferably 92 or more, especially preferably 93 or more, yet more preferably 94 or more, even more preferably 95 or more, yet even more preferably 96 or more, still even more preferably 97 or more, most preferably 98 or more.

In a preferred embodiment of the assembly of the invention, the colour rendering index R9 of the output light is 90 or more, particularly preferably 91 or more, more preferably 92 or more, especially preferably 93 or more, yet more preferably 94 or more, even more preferably 95 or more, yet even more preferably 96 or more, still even more preferably 97 or more, most preferably 98 or more.

In a preferred embodiment of the assembly of the invention, each of the colour rendering indices R1 to R8 of the output light is 80 or more, preferably 85 or more, particularly preferably 90 or more, more preferably 91 or more, especially preferably 92 or more, most preferably 93 or more.

In a preferred embodiment of the assembly of the invention, each of the colour rendering indices R1 to R14 of the output light is 80 or more, preferably 85 or more, particularly preferably 90 or more, more preferably 91 or more, especially preferably 92 or more, most preferably 93 or more.

In a preferred embodiment, the output light has a correlated colour temperature in the range 3000 to 6700K, preferably 3200 to 6000K, particularly preferably 3500 to 5500K, more preferably 4000 to 4600K (e.g., about 4300K).

Preferably the illumination device further comprises:

one or more converging elements positioned relative to the one or more white LEDs and one or more red-orange LEDs to manipulate the first light and second light to form the output light.

The (or each) converging element may be a focusing element or beam shaping element or beam converging element.

The output light may be converged to a beam or spot. The spot (or beam) size may be 100-400 mm in diameter. The output light may be focussed to a spot (e.g., a round spot) 0.5 m or more (e.g., up to 1 m) in front of the assembly (reference to D10). An advantage of the present invention is that it permits the converging element to produce a broad spot of uniform intensity (in contrast to the Gaussian distribution of the intensity of a spot observed in accordance with conventional arrangements).

The (or each) converging element is preferably a reflector element. The (or each) reflector element may be a beam shaping reflector such as an ellipsoidal reflector element. The LED is typically positioned at or near to a first focal point of the ellipsoidal reflector element. The spot may be at the second focal point of the ellipsoidal reflector element. The reflector element may be a large aperture reflector element.

In a preferred embodiment, the reflector element is a single reflector element.

In a preferred embodiment, the one or more white LEDs and one or more red-orange LEDs are clustered into a plurality of clusters, wherein the device further comprises:

a plurality of reflector elements, wherein a reflector element is positioned discretely relative to each cluster to converge the first light and the second light from each cluster to form the output light.

The (or each) converging element is preferably a lens. The lens may be a movable focussing lens. The lens may be a static converging lens. The lens may be a beam shaping lens such as a TIR lens, a spheric or aspheric lens (such as condenser, Fresnel or diffractive lenses). The lens may be a beam converging lens, such a wedge lens, Fresnel lens, spheric or aspheric lens.

Preferably the beam size of the first light from the one or more white LEDs is variable relative to the beam size of the second light from the one or more red-orange LEDs. The one or more white LEDs and one or more red-orange LEDs may be clustered, and the beam size of the first, second or output light from the clusters may be varied.

In a preferred embodiment the beam size of the first light from the one or more white LEDs is independently adjustable.

In a preferred embodiment, the beam size of the second light from the one or more red-orange LEDs is independently adjustable.

Preferably the intensity of the first light from the one or more white LEDs is variable relative to the intensity of the second light from the one or more red-orange LEDs. This allows the colour rendition to be optimised at a particular colour temperature and varied as required.

In a preferred embodiment, the intensity of the first light from each of the one or more white LEDs is independently adjustable.

In a preferred embodiment, the intensity of the second light from the one or more red-orange LEDs is independently adjustable.

In a preferred embodiment, the device is capable of performing solid state focussing.

In a preferred embodiment, the one or more white LEDs and one or more red-orange LEDs are provided in an array, wherein the array is a plurality of discrete first and second clusters. Preferably each first cluster in this embodiment is a cluster of narrow beam LEDs and each second cluster is a cluster of broad beam LEDs. Preferably the beam size of the output light from the first cluster is narrower than the beam size of the output light from the second cluster. The difference between the beam size of the output light from the first cluster and the beam size of the output light from the second cluster may be variable. Alternatively, preferably each first cluster and each second cluster in this embodiment is a cluster of narrow beam LEDs and broad beam LEDs. Preferably the intensity of the output light from the first cluster is variable relative to the intensity of the output light from the second cluster. The variability of the intensity permits the beam size (spot diameter) to be controlled (i.e., change focus) where the narrow and broad beam sizes are fixed.

The device may further comprise a heat sink. Typically the heat sink is mounted rearwardly in the housing. A controller and processor may be included in the device to control the LEDs in accordance with known techniques.

Typically the housing is a luminaire.

In a preferred embodiment, the illumination assembly further comprises:

a measuring device for measuring the operating temperature;

a power device for supplying power to the one or more white LEDs and one or more red-orange LEDs; and a power adjustment device operatively connected to the measuring device and to the power device, wherein in use the power adjustment device causes the power device to adjust the power supply in response to a change in the operating temperature.

The measuring device may be a thermistor. The power adjustment device may be an integrated circuit.

The assembly of the present invention may be used in domestic or commercial applications. The applications may be medical (e.g., surgical or diagnostic) or non-medical (e.g., in forensic science, retail displays, museums and exhibitions, studio lighting, room lighting, architectural or machine vision). The assembly of the present invention may be used in colour matching (e.g., checking print quality). The assembly may be chip-mounted. With regard to medical lighting, the assembly of the invention enables high quality light to be produced from LED sources with excellent colour rendering characteristics at specific colour temperatures. It also enables the colour temperature to be adjusted, by altering the red-orange mix.

In a preferred embodiment, the illumination assembly is without a colour filter in the path of the output light (e.g., in the third path or at the field position). Preferably the illumination assembly is without a colour filter in the first path of the light and without a colour filter in the second path of the second light.

BRIEF DESCRIPTION OF THE DRAWINGS

The present invention will now be described in a non-limitative sense with reference to examples and to the accompanying FIGS. in which.

DETAILED DESCRIPTION OF THE INVENTION

Figure 1:
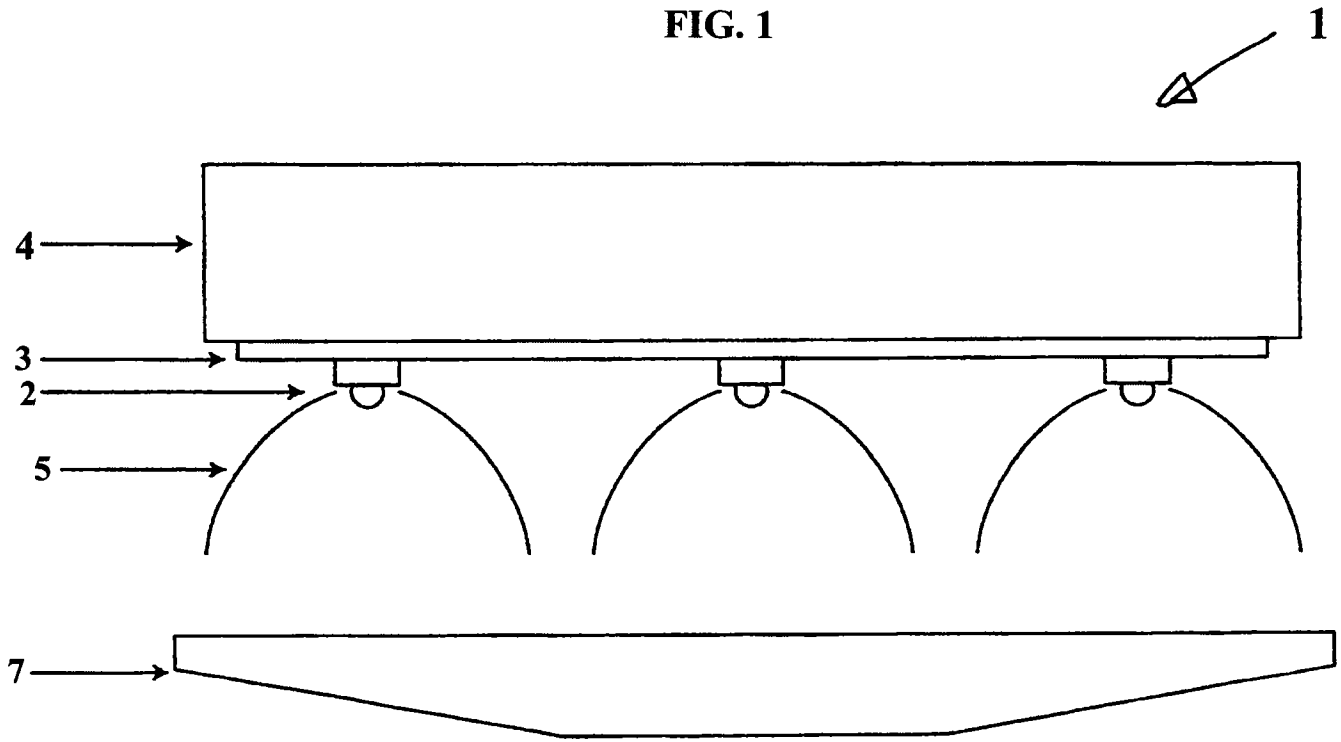
FIG. 1: A first embodiment of the illumination assembly of the invention shown schematically in cross-section.

A first embodiment of the illumination assembly of the invention 1 is illustrated schematically in cross-section in FIG. 1. One or more white LEDs and one or more red-orange LEDs 2 on a printed circuit board 3 are mounted in a housing (not shown). To the rear of the printed circuit board 3 is a heat sink 4. Each LED 2 is equipped with a beam shaping reflector 5. Light from the white and red-orange LEDs passes through a wedge lens 7 which converges and mixes the light beam into an output light to a spot.

Figure 2B:
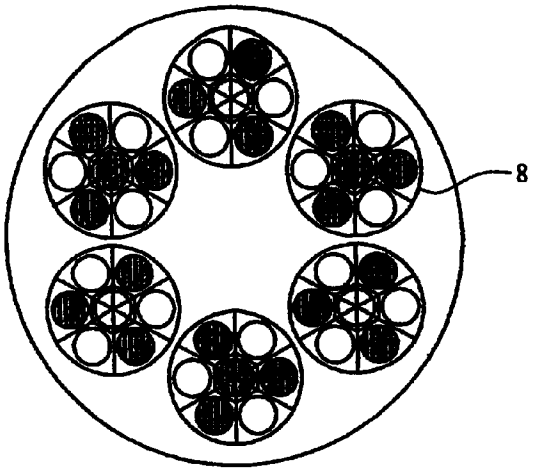
FIGS. 2A to 2D: A plan view of a second, third, fourth and fifth embodiment of the illumination assembly of the invention.
Figure 2A:
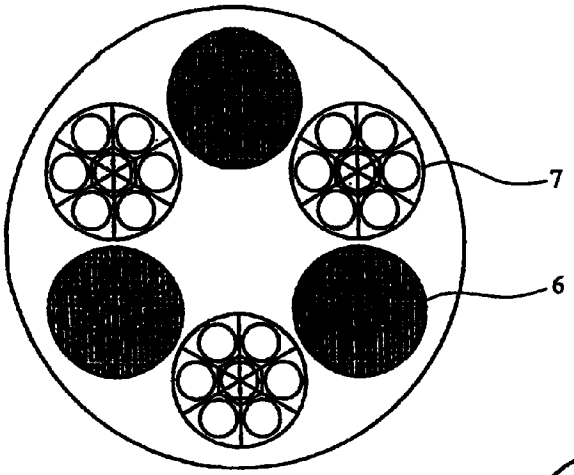
Figure 2C:
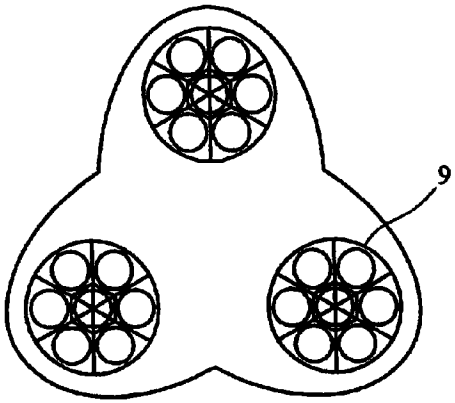

FIGS. 2A to 2C illustrate in plan view second, third and fourth embodiments of the illumination assembly of the invention with a similar arrangement of parts to that of FIG. 1 described above. In these embodiments, narrow beam and wide beam white LEDs and red-orange LEDs are disposed in an array of hexagonal clusters. In each hexagonal cluster, a red-orange LED sits at the centre of the white LEDs.

In the second embodiment (FIG. 2A), hexagonal clusters 6 of narrow beam red-orange LEDs and white LEDs (shaded) and hexagonal clusters 7 of wide beam white LEDs and red-orange LEDs (unshaded) are disposed in a hexagonal array which is capable of solid state focusing. A red-orange LED lies at the centre of each cluster.

In the third embodiment (FIG. 2B), hexagonal clusters 8 of alternating narrow beam (shaded) and wide beam (unshaded) white and red-orange LEDs are in a hexagonal array which is capable of solid state focussing. A red-orange LED lies at the centre of each cluster.

In the fourth embodiment (FIG. 2C), hexagonal clusters 9 of narrow beam (unshaded) white and red-orange LEDs are in a triangular array which is incapable of solid state focussing. A red-orange LED lies at the centre of each cluster.

Figure 2D:
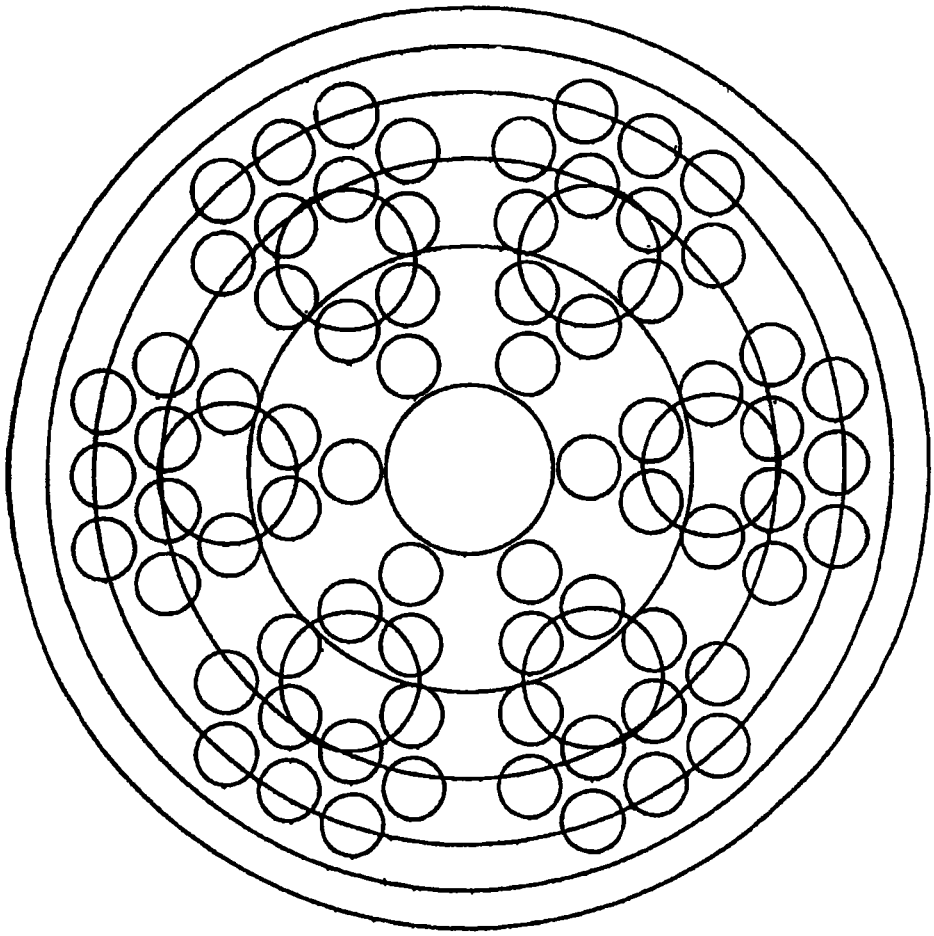

FIG. 2D illustrates in plan view a fifth embodiment with a similar arrangement of parts to that of FIG. 1 described above or FIG. 3 described below. In this embodiment, white LEDs and red-orange LEDs are disposed in a complex array.

Figure 3:
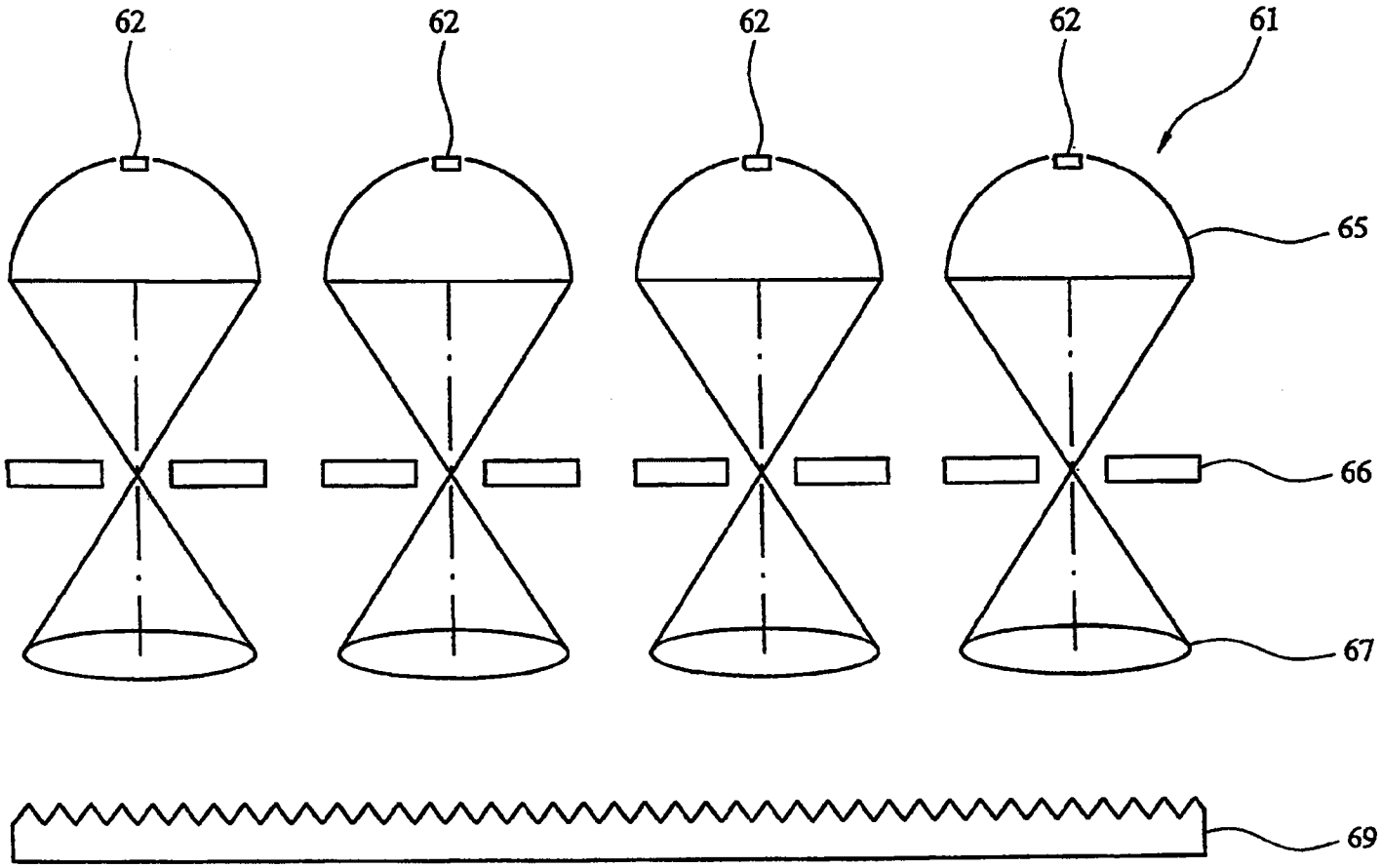
FIG. 3: A sixth embodiment of the illumination assembly of the invention shown schematically in cross-section.

A sixth embodiment of the assembly of the invention 61 is illustrated schematically in cross-section in FIG. 3. One or more white LEDs and one or more red-orange LEDs 62 are mounted in a housing (not shown). Each LED 62 is positioned at a first focal point of an ellipsoidal reflector 65 which re-images the LED to the second focus of the ellipsoidal reflector 65 which is approximately in the same plane as an array of apertures 66. This second focus is then re-imaged by an array of lenses 67 to the field of interest (0.5-1 m away). Mixed light from the white and red-orange LEDs 62 passes through a converging Fresnel lens 69 which converges the light into an output light beam focussed onto a spot. By mechanically moving the array of lenses 67 the spot size at the field position can be adjusted. This gives a mechanical means for adjusting the beam size.

Figure 4:
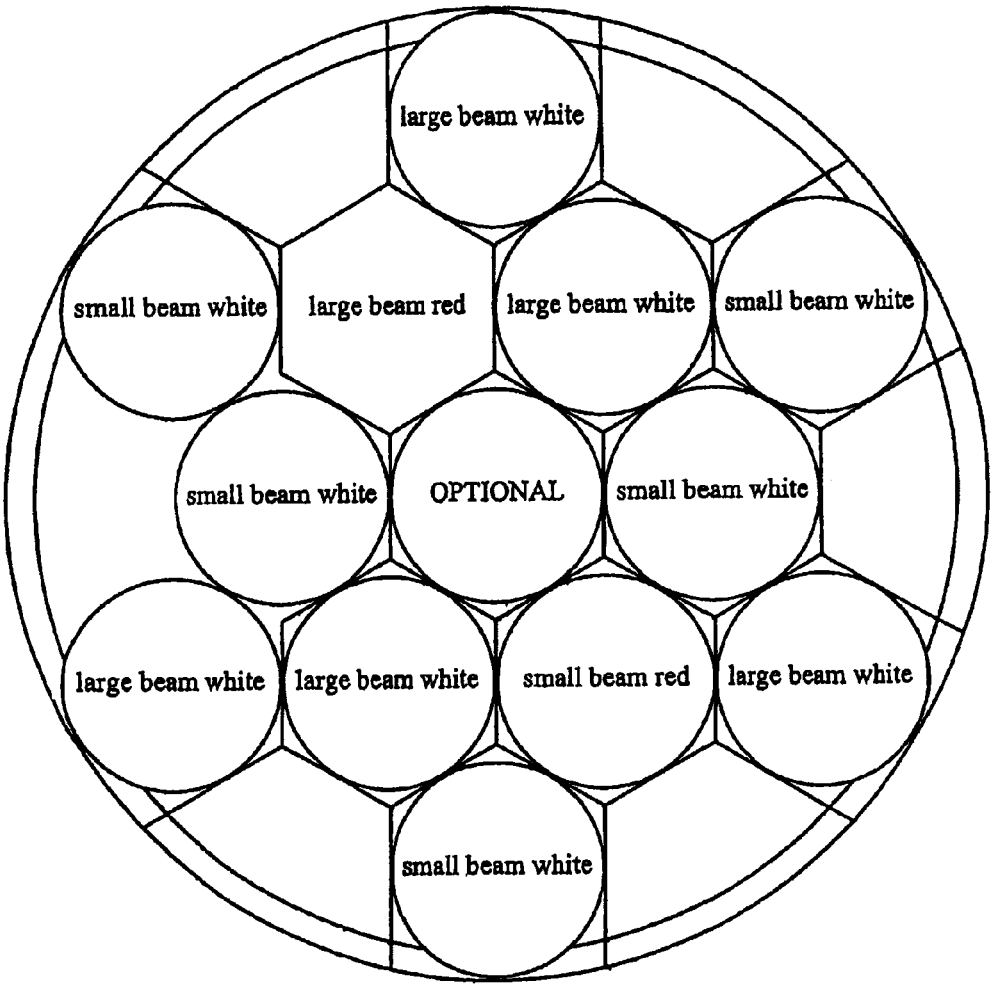
FIG. 4: A plan view of a seventh embodiment of the illumination assembly of the invention.

FIG. 4 illustrates in plan view a seventh embodiment with a similar arrangement of parts to that of FIGS. 1 and 2 described above. White LEDs and red-orange LEDs are disposed in a honeycomb array with varying beam sizes (as denoted) to permit solid state focussing.

Figure 5:
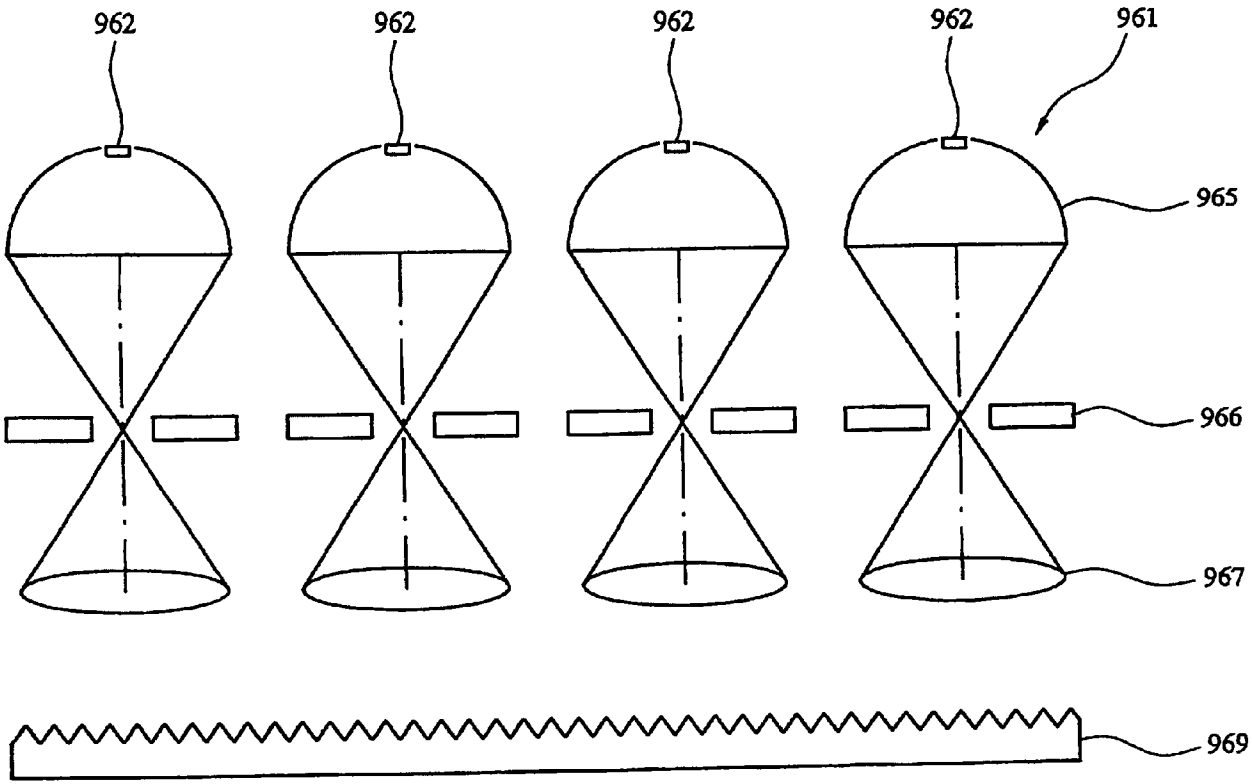
FIG. 5: An eighth embodiment of the illumination assembly of the invention shown schematically in cross-section.

An eighth embodiment of the illumination assembly of the invention 961 is illustrated schematically in cross-section in FIG. 5. One or more white LEDs and one or more red-orange LEDs 962 are mounted in a housing (not shown). Each LED 962 is positioned at a first focal point of an ellipsoidal reflector 965 which re-images the LED to the second focus of the ellipsoidal reflector 965 which is approximately in the same plane as an array of apertures 966. This second focus is then re-imaged by an array of lenses 967 to the field of interest (0.5-1 m away). Mixed light from the white and red-orange LEDs 962 passes through a converging Fresnel lens 969 which converges the light into an output light beam focussed onto a spot. By mechanically moving the array of lenses 967, the spot size at the field position can be adjusted. This gives a mechanical means for adjusting the beam size.

EXAMPLE

TABLE 1

Measured colour parameters from light generated using white LEDs and red-orange LEDs.

| White bin | Peak CRI | CCT | R9 |
|---|---|---|---|
| VN | 91.1 | 3502 | 89.8 |
| WO | 89.9 | 4368 | 93.4 |
| WN | 94.4 | 4280 | 94.2 |
| XO | 90 | 5181 | 86.7 |
| XN | 90.5 | 5416 | 90.5 |

The colour rendering index R9 and correlated colour temperature of combinations of red-orange LUXEON® LEDs with various white LUXEON® LEDs were measured (see Table 1). The net effect of the presence of the red-orange LED on the white LEDs is that the colour rendition of the source is improved at a particular correlated colour temperature.

The light produced by the combination of the white LEDS from bins WN and WO and the red-orange LED has almost ideal characteristics for medical lighting, i.e., it has an excellent colour rendering index (high R9 and Ra) at a desirable correlated colour temperature of about 4300K.

The light produced by the combination of the white LEDS from bin VN and the red-orange LED has a lower correlated colour temperature with excellent colour rendition. This is an ideal light source for room lighting.

The light produced by the combination of the white LEDS from bins XO or XN and the red-orange LED has a higher colour temperature with excellent colour rendition. This creates a good match to midday daylight.

What is claimed is:

1. An illumination assembly capable of emitting an output light comprising:

a housing; and a light source being two different types of LEDs, wherein one type of LED is one or more white LEDs emitting a first light along a first path and the other type of LED is one or more red-orange LEDs emitting a second light along a second path, wherein the one or more white LEDs and the one or more red-orange LEDs are mounted in the housing such that the first light and the second light are mixed to form the output light transmitted along a third path or to form the output light at a field position, wherein the colour rendering index Ra of the output light is 85 or more and the colour rendering index R9 of the output light is 85 or more, wherein the one or more white LEDs and one or more red-orange LEDs are provided in an array, wherein the array is a plurality of discrete first and second clusters.

2. An illumination assembly as claimed in claim 1 wherein each of the one or more white LEDs is a cold white LED.

3. An illumination assembly as claimed in claim 1 or 2 wherein the white LEDs have a correlated colour temperature in the range 5000-7000K.

4. An illumination assembly as claimed in claim 1 wherein the chromaticity coordinate (X) of each of the one or more white LEDs is in the range 0.300 to 0.350.

5. An illumination assembly as claimed in claim 1 wherein the chromaticity coordinate (Y) of each of the one or more white LEDs is in the range 0.310 to 0.375.

6. An illumination assembly as claimed in claim 1 wherein each of the one or more white LEDs is a LUXEON® white LED selected from the group consisting of bin WN, UN, UO, WO, XN, XO and VN.

7. An illumination assembly as claimed in claim 6 wherein each of the one or more white LEDs is a LUXEON® white LED selected from the group consisting of bin WO or WN.

8. An illumination assembly as claimed in claim 1 wherein each of the one or more red-orange LEDs has a dominant wavelength in the range 613 to 621 nm.

9. An illumination assembly as claimed in claim 1 wherein the colour rendering index Ra of the output light is 90 or more.

10. An illumination assembly as claimed in claim 1 wherein the colour rendering index R9 of the output light is 90 or more.

11. An illumination assembly as claimed in claim 1 wherein the output light has a correlated colour temperature in the range 4000 to 4600 K.

12. An illumination assembly as claimed in claim 1 wherein each first cluster is a cluster of narrow beam LEDs and each second cluster is a cluster of broad beam LEDs.

13. An illumination assembly as claimed in claim 1 wherein the beam size of the output light from the first cluster is narrower than the beam size of the output light from the second cluster.

14. An illumination assembly as claimed in claim 12 or 13 wherein the difference between the beam size of the output light from the first cluster and the beam size of the output light from the second cluster is variable.

15. An illumination assembly as claimed in claim 12 or 13 wherein the intensity of the output light from the first cluster is variable relative to the intensity of the output light from the second cluster.

16. An illumination assembly as claimed in claim 1 wherein each first cluster and each second cluster is a cluster of narrow beam LEDs and broad beam LEDs.

17. An illumination assembly as claimed in claim 16 wherein the intensity of the output light from the first cluster is variable relative to the intensity of the output light from the second cluster.

* * * * *